US006701878B2

(12) United States Patent
Ohe et al.

(10) Patent No.: US 6,701,878 B2
(45) Date of Patent: Mar. 9, 2004

(54) VARIABLE VALVE TIMING DEVICE

(75) Inventors: Shinji Ohe, Toyota (JP); Yoshiyuki Kawai, Toyota (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 10/374,969

(22) Filed: Feb. 28, 2003

(65) Prior Publication Data

US 2003/0177993 A1 Sep. 25, 2003

(30) Foreign Application Priority Data

Feb. 28, 2002 (JP) ..... 2002-054040

(51) Int. Cl.[7] ..... F01L 1/34

(52) U.S. Cl. ..... 123/90.17; 123/90.16; 92/124; 464/1; 464/2

(58) Field of Search ..... 123/90.17, 90.15, 123/90.16, 90.31, 90.6, 90.67; 464/1, 2, 54, 61; 92/17, 24, 124, 120–127; 91/173

(56) References Cited

U.S. PATENT DOCUMENTS 6,039,016 A * 3/2000 Noguchi ..... 123/90.17

FOREIGN PATENT DOCUMENTS

JP 11-132014 A 5/1999

* cited by examiner

*Primary Examiner*—Thomas Denion
*Assistant Examiner*—Kyle Riddle
(74) *Attorney, Agent, or Firm*—Burns, Doane, Swecker & Mathis, LLP

(57) ABSTRACT

A variable valve timing device includes a rotation transmitting member rotated integrally with a rotation shaft of an engine, a rotor member disposed in the rotation transmitting member to be rotated relative to the rotation transmitting member and rotated integrally with an intake and exhaust valves controlling member, a fluid chamber defined between the rotor member and the rotation transmitting member, a vane radially equipped to one of the rotor member and the rotation transmitting member, and a covering member fixed to the rotation transmitting member for covering the fluid chamber. An axial edge surface of the biasing member discontinuously comes in contact with at least one of the rotor member and the covering member.

14 Claims, 4 Drawing Sheets

VARIABLE VALVE TIMING DEVICE

CROSS REFERENCE TO RELATED APPLICATIONS

This application is based on and claims priority under 35 U.S.C. §119 with respect to a Japanese Patent Application 2002-054040, filed on Feb. 28, 2002, the entire content of which is incorporated herein by reference.

FIELD OF THE INVENTION

This invention generally relates to a variable valve timing device for controlling opening and closing timing of intake and exhaust valves of an internal combustion engine.

BACKGROUND OF THE INVENTION

A known variable valve timing device has been disclosed in a Japanese Patent Laid-Open published as No. 1999 (H11)-132014. The disclosed variable valve timing device includes a rotation transmitting member rotatable integrally with one of a rotation shaft of an engine and an intake and exhaust valves controlling member, which is capable of controlling an opening and closing of the intake and exhaust valves of the engine. The disclosed variable valve timing device further includes a rotor member disposed in the rotation transmitting member so as to be rotated relative to the rotation transmitting member and rotatable integrally with the other of the rotation shaft of the engine and the intake and exhaust valves controlling member. A fluid chamber is defined between the rotor member and the rotation transmitting member. A vane is radially equipped to either the rotor member or the rotation transmitting member so as to divide the fluid chamber into an advanced angle chamber and a retarded angle chamber. A covering member is fixed to the rotation transmitting member so as to cover the fluid chamber. A biasing member, for example a torsion coil spring, is disposed between the closing member and the rotor member so as to bias the rotor member in a rotative direction. In this known variable valve timing device with the above-described structure, each of the covering member and the rotor member is provided with a groove which houses an edge portion of the biasing member and possesses a spiral shaped structure.

According to the above-disclosed variable valve timing device, each groove of the covering member and the rotor member comes in contact with an entire rolled edge surface of the biasing member. Accordingly, a contact resistance between the biasing member and each groove is relatively large when the rotor member is rotated relative to the rotation transmitting member. In this case, the rotating performance of the rotor member relative to the rotation transmitting member may be deteriorated, thereby affecting on operation of the variable valve timing device.

The present invention therefore seeks to provide an improved variable valve timing device in which a relative rotation of a rotor member and a rotation transmitting member may be smoothly performed as being intended, thereby the performance of the variable valve timing device can be improved.

SUMMARY OF THE INVENTION

According to an aspect of the present invention, a variable valve timing device includes a rotation transmitting member rotated integrally with one of a rotation shaft of an engine and an intake and exhaust valves controlling member for controlling an opening and closing of intake and exhaust valves of the engine, and a rotor member disposed in the rotation transmitting member to be rotated relative to the rotation transmitting member and rotated integrally with the other of the rotation shaft of the engine and the intake and exhaust valves controlling member, a fluid chamber defined between the rotor member and the rotation transmitting member, a vane radially equipped to one of the rotor member and the rotation transmitting member so as to divide the fluid chamber into an advanced angle chamber and a retarded angle chamber, a covering member fixed to the rotation transmitting member for covering the fluid chamber, and a biasing member disposed between the covering member and the rotor member for biasing the rotor member in a rotative direction thereof. An axial edge surface of the biasing member discontinuously comes in contact with at least one of the rotor member and the covering member.

At least the one of the rotor member and the covering member includes a recessed portion for housing an axial edge portion of the biasing member. The recessed portion possesses a discontinuous surface at a bottom thereof.

The biasing member is a torsion spring of which one end is engaged to the covering member and other end is engaged to the rotor member. The recessed portion for housing the axial edge portion of the torsion spring is a groove with a substantially helical shaped structure. The discontinuous surface is provided at a bottom of the groove with the substantially helical shaped structure.

BRIEF DESCRIPTION OF THE DRAWING FIGURES

The foregoing and additional features and characteristics of the present invention will become more apparent from the following detailed description considered with reference to the accompanying drawing figures wherein.

DETAILED DESCRIPTION OF THE INVENTION

Figure 1:
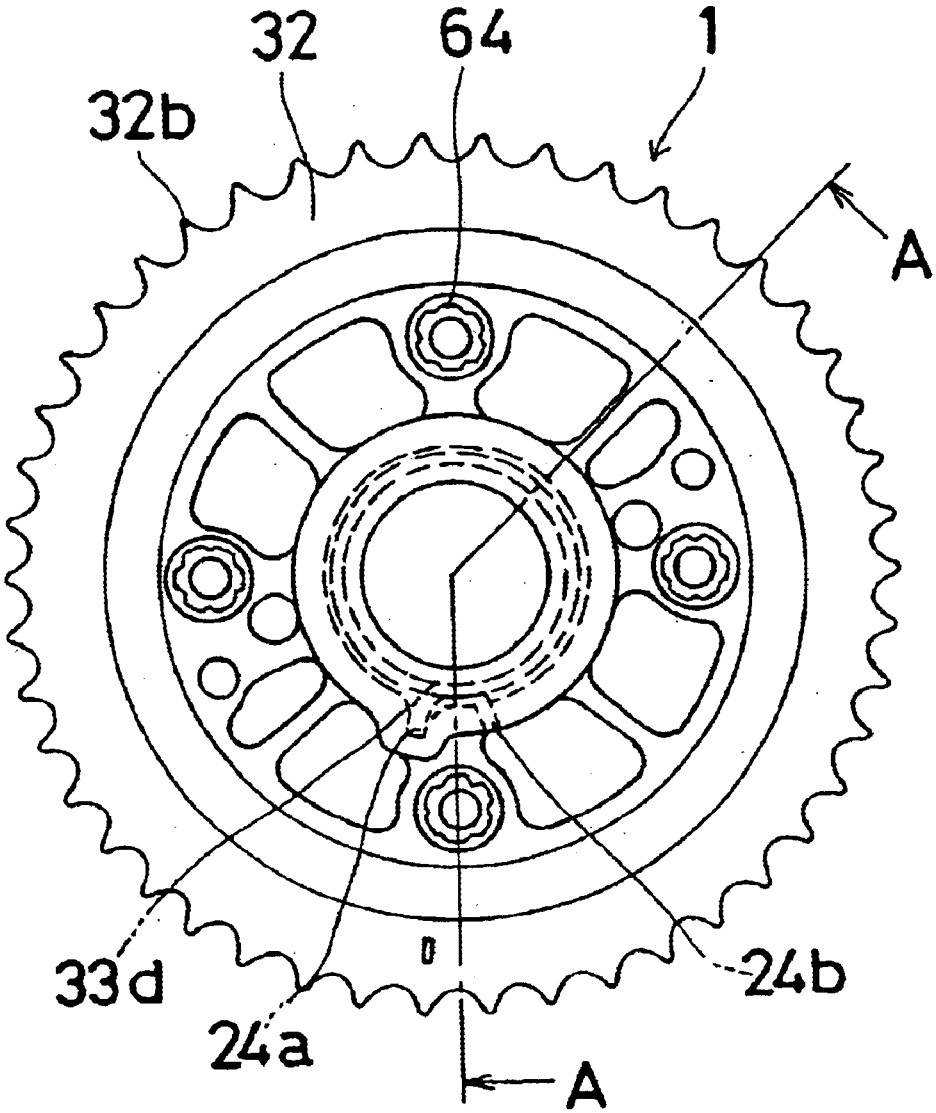
FIG. 1 is a front view illustrating a variable valve timing device according to an embodiment of the present invention.

As illustrated in FIG. 1, a gear 32 is connected to a rotation shaft of an engine, such as a crank shaft 100, a member equipped to the crank shaft (not shown), or the like, via a timing chain 90. More particularly, the gear 32 is integrally provided with a sprocket portion 32*b* on its outer periphery and is connected to the rotation shaft of the engine via the timing chain 90 hooked around the sprocket portion 32*b*. The gear 32 is assembled with a housing member 31 (described later). A plate member (a covering member) 33 (described later) covers an end surface of the housing 31 which is opposite to the other end surface thereof at a side of the gear 32. The plate member 33 possesses an outer periphery which substantially corresponds to an outer periphery of the housing member 31. The gear 32, the housing member 31, and the plate member 33 are fixed at four portions with a constant distance in a peripheral portion between each portion by means of fastening members 64 such as bolts with flanges, whereby the gear 32, the housing member 31, and the plate member 33 can be integrated.

According to the embodiment of the present invention, an engine power transmitting is described in accordance with a structure of which the rotation of the crank shaft 100 is transmitted to the gear 32 via the timing chain 90. However, the engine power transmitting is not limited to the aforementioned structure. Alternatively, the engine power transmitting can be performed by use of a belt member, which substitutes for the timing chain 90, and, a pulley, which substitutes for the gear 32. The housing 31 and the gear 32 functions as a rotation transmitting member for transmitting an engine revolution to a cam shaft 10 (an intake and exhaust valves controlling member).

Figure 2:
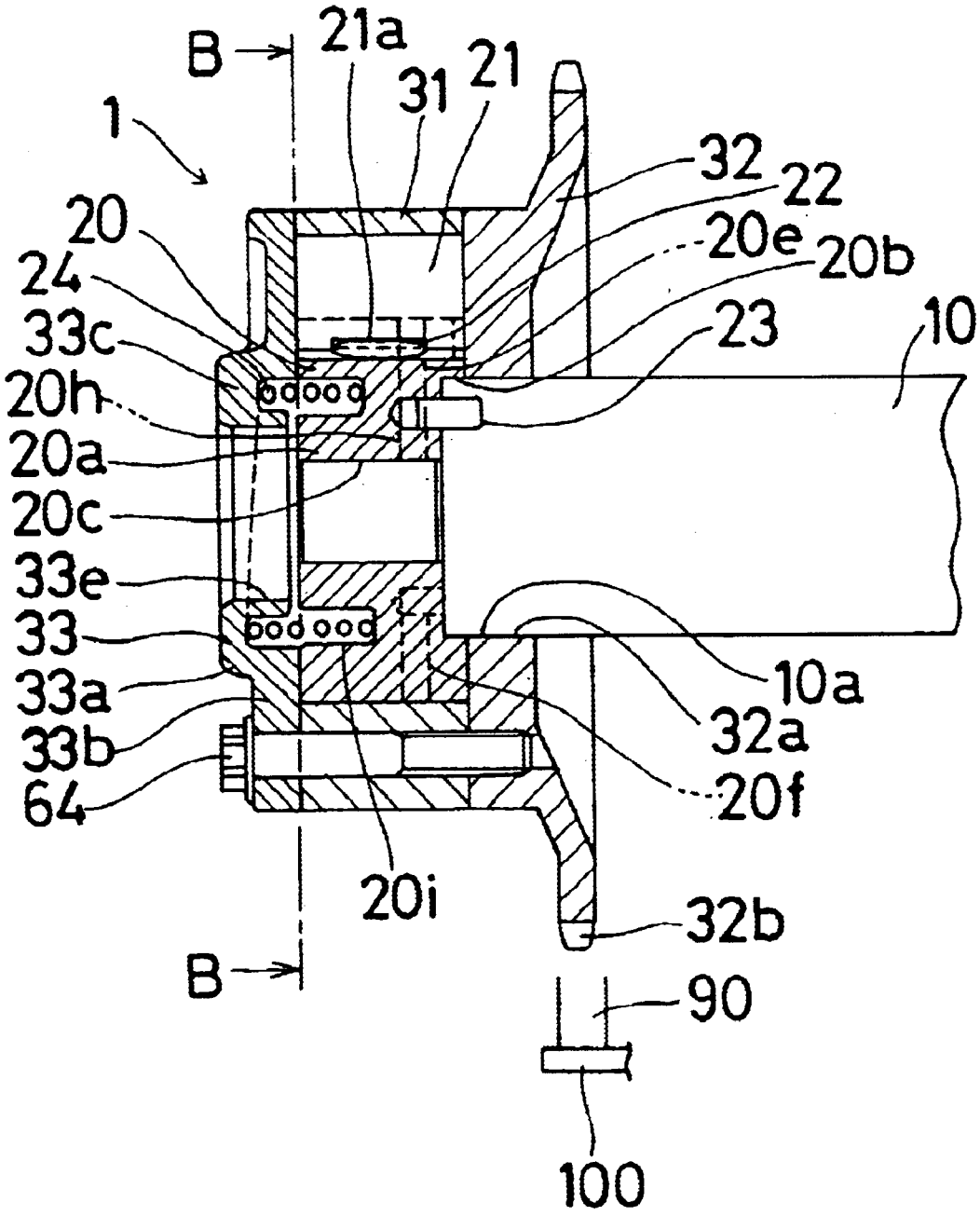
FIG. 2 is a cross sectional view of FIG. 1 taken along a line A—A.

As illustrated in FIG. 2, the gear 32 possesses an approximately convex cross section in an axial direction thereof. The gear 32 is provided with a bore at a central portion thereof so as to insert the cam shaft 10 which controls the opening and closing time of intake and exhaust valves of the engine (not shown). An inner peripheral surface 32*a* of the gear 32 slidably comes in contact with an outer peripheral surface 10*a* of the cam shaft 10. According to the embodiment of the present invention, the housing member 31 is a separated assembly from the gear 32. However, the housing member 31 can be a unit with the gear 32.

The housing member 31 possesses an approximately cylindrical shaped structure opening in an axial direction thereof and has four shoe portions 31*b* projecting in a radially inward direction thereof so as to define four recessed portions 31*a* respectively opened with approximately arc shaped structures. The respective recessed portions 31*a* function as fluid chambers. The housing member 31 further has two pairs of recessed portions 31*c* at an outer peripheral surface. The respective pairs of recessed portions 31*c* are arranged relative to an axis of the housing member 31 and relative to a normal line of the axis thereof. Each shoe portion 31*b* is provided with an inserting bore 31*f* for inserting each fastening member 64. The inserting bores 31*f* are arranged not to be parallel with the recessed portions 31*c* in a circumferential direction of the housing member 31.

The plate member 33 covering the end surface of the housing 31 is provided with a central bore 33*e*, a boss portion 33*a* at a radially outside of the central bore 33*e*, and a fixing portion 33*b*. The plate member 33 is fixed with the housing member 31 and the gear 32 at the four portions in the circumferential direction by means of the fastening members 64.

The rotor member 20 possesses an outer peripheral surface slidably in contact with an inner peripheral surface of the shoe portions 31*b* of the housing member 31 so that the rotor member 20 can be rotated relative to the housing member 31. The rotor member 20 is provided with an inner bore 20*c* at a central portion thereof so as to insert a bolt (not shown) fixed to an end of the cam shaft 10. A recessed portion 20*b* is defined at an end portion at a side of the rotor member 20 fixed to the cam shaft 10. A positioning pin 23 is disposed in the recessed portion 20*b* so as to position the rotor member 20 and the cam shaft 10. Therefore, the cam shaft 10 is always positioned at a predetermined position relative to the rotor member 20, thereby the relative rotation of the cam shaft 10 and the rotor member 20 is not allowed in favor of the positioning pin 23. The bolt (not shown) disposed in the rotor member 20 is screwed with the cam shaft 10, whereby the rotor member 20 and the cam shaft 10 can be rotated as a single unit. In this case, as described above, the outer peripheral surface 10*a* of the cam shaft 10 is slidably in contact with the inner peripheral surface 32*a* of the gear 32, and the outer peripheral surface of the rotor member 20 is slidably in contact with the inner peripheral surfaces of the shoe portions 31*b*.

The rotor member 20 includes four axially extending passage bores 20*h*, three passage bores 20*f*, which extend from the passage bores 20*h* in a radially outward direction and communicate with the recessed portions 31*a*, a single passage bore 20*f*, which communicates with the recessed portion 31*a* via a lock bore 20*g*, and four passage bores 20*e*, which communicates with the inner bore 20*c* of the rotor member 20. A clearance between the inner bore 20*c* and the not-shown bolt disposed therein functions as a passage and communicates with a passage (not shown) defined in the cam shaft 10. These passages function as an oil passage for supplying operation oil to a retarded angle chamber R2 (described later). The passage bores 20*f*, the axial bores 20*h*, and a passage (not shown) being different from the passage defined in the cam shaft 10 function as an oil passage for supplying operation oil to an advanced angle chamber R1.

The outer peripheral surface of the rotor member 20 is provided with four vane grooves 20*d* radially outwardly extending from a center of the rotor member 20 so as to respectively dispose four vanes 21 therein. As illustrated in FIG. 2, each vane 21 possesses a recessed portion 21*a* at an inner diameter side and disposes a leaf spring 22 with an approximately C shaped cross section. Therefore, each vane 21 is biased in a radially outward direction by the leaf spring 22, thereby an end portion of the vane 21 comes in contact with an inner wall of the recessed portion 31*a*. Therefore, each recessed portion 31*a* is divided into two chambers via the vane 21. The left-hand side of the two chambers is the advanced angle chamber R1 and the right-hand side thereof is the retarded angle chamber R2.

One of the four shoe portions 31*b* of the housing member 31 is provided with a bore 31*g* disposing a lock spring 62 therein. A known torsion spring is adopted as the lock spring 62 and one end thereof is engaged to an inner wall of the bore 31*g* and the other end thereof is in contact with an end portion of a lock plate 61. The lock plate 61 is assembled to be freely slidable between the bore 31*g* and a retracting bore 31*e* in the radial direction of the housing member 31. When the rotor member 20 is positioned with a predetermined phase relative to the housing member 31, the retracting bore 31*e* is positioned to oppose the lock bore 20*g* which is defined on the outer peripheral surface of the rotor member 20. In this case, the lock plate 61 is projected toward the lock bore 20*g* by a biasing force of the lock spring 62 and is then engaged with the lock bore 20*g*. Once the lock plate 61 is engaged with the lock bore 20*g*, the rotor member 20 can not be rotated relative to the housing member 31. On the other hand, when the operation oil is supplied to the lock bore 20*g* communicating with the passage bore 20*f*, the lock plate 61 is retracted to the retracting bore 31*e* against the biasing force of the lock spring 62 and is then released from the engaged condition to the lock bore 20*g*. In this case, the rotor member 20 can be freely rotated relative to the housing member 31.

Figure 3:
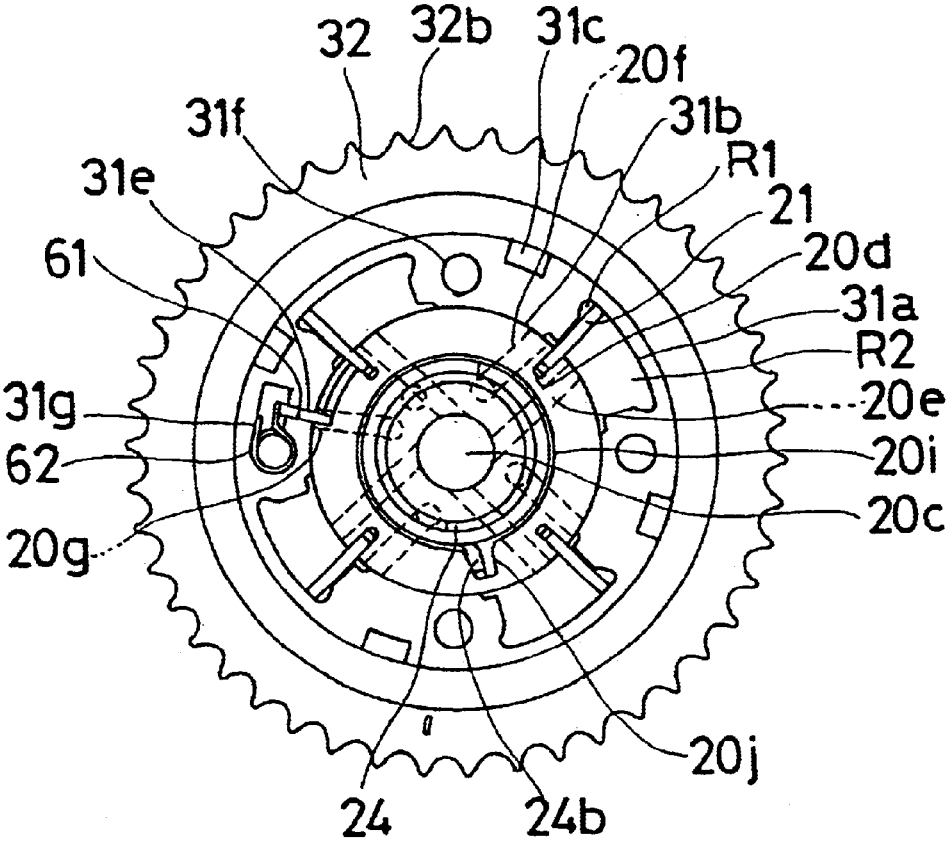
FIG. 3 is an arrow view of FIG. 2 taken along a line B—B.

As especially seen in FIG. 2, a coil shaped torsion spring 24 is disposed between the rotor member 20 and the plate member 33. The rotor member 20 includes an approximately annular shaped groove portion 20*i* axially opened in the rotor member 20 at a side of an edge surface 20*a*. The plate member 33 also includes an approximately annular shaped groove portion 33*c* axially opened in the plate member 33 at a side of a contact surface with the rotor member 20. One end 24*a* of the torsion spring 24 is engaged with an engaging portion 33*d* (shown in FIG. 1) axially defined in the plate member 33 and the other end 24*b* of the torsion spring 24 is engaged with an engaging portion 20*j* (shown in FIG. 3) axially defined in the rotor member 20. The torsion spring 24 disposed as described above always biases the rotor 20, i.e. the cam shaft 10, in a clockwise direction so as to maintain the advanced angle chamber R1 with a maximum inner space and the retarded angle chamber R2 with a minimum inner space.

Figure 4:
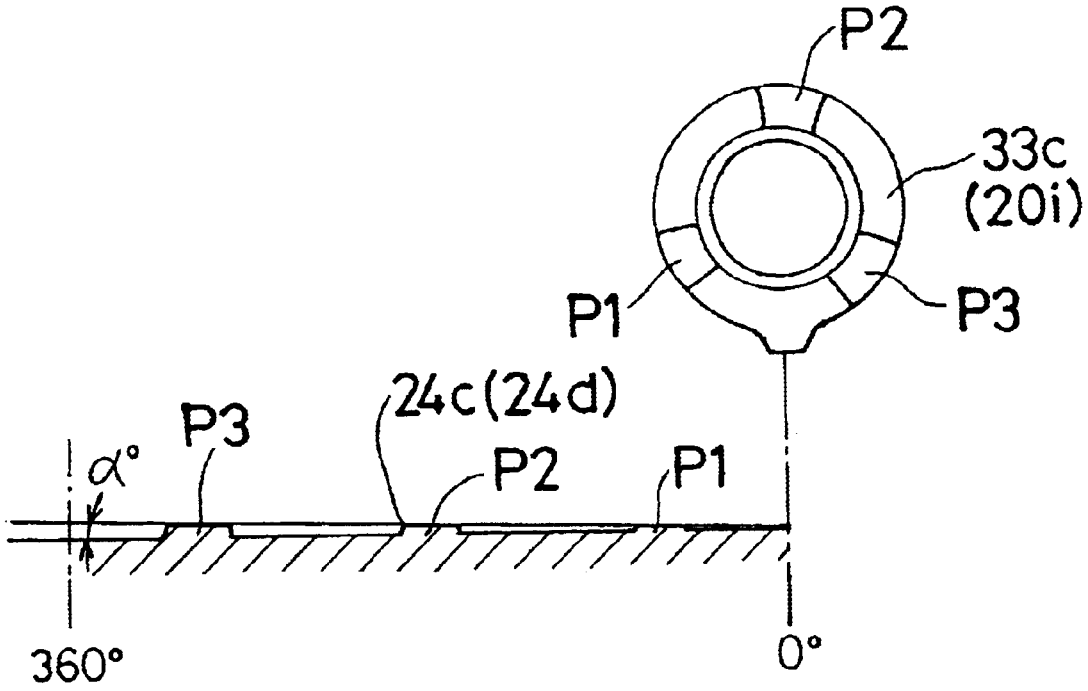
FIG. 4 is a schematic explanatory view linearly illustrating a cross section of an annular groove of a rotor member or a plate member so as to explain a structure of a projection provided at the annular groove portion thereof.

Each bottom portion of the annular groove portions 20*i* and 33*c* is provided with three projections (discontinuous surfaces) P1, P2, and P3 which have a constant distance between the adjacent projections in a circumferential direction thereof. The projections P1, P2, and P3 of the grooves 20*i* and 33*c* are designed to go up in height in this order corresponding to the axial shape of edge surfaces 24*c* and 24*d* of the torsion spring 24. More specifically, as illustrated in FIG. 4, each surface of each projection P1, P2, and P3 possesses a taper shaped structure with a predetermined angle $\alpha$ relative to a surface vertical to an axis of the plate member 33 or the rotor member 20. Therefore, a surface connecting the surfaces of the projections P1, P2, and P3 possesses a substantially helical shaped structure, wherein the edge surface 24*c* or 24*d* of the torsion spring 24 discontinuously (i.e. without having successive contact portions) comes in contact with the plate member 33 and the rotor member 20 via the three projections P1, P2, and P3. The predetermined angle $\alpha$ is represented by the following formula (inequality).

$$\alpha \geqq \tan^{-1}(\phi d/(\phi D \times \pi))$$

$$\phi D2 \geqq \phi D \geqq \phi D1$$

where, $\phi$d: diameter of coil of the torsion spring $\phi$D: central diameter of the torsion spring $\phi$D1: outer diameter of the groove $\phi$D2: inner diameter of the groove As the groove portions 20*i* and 33*c* according to the embodiment of the present invention are designed with the foregoing structure, a contact area of the torsion spring 24 with the groove portions 20*i* and 33*c* can be effectively decreased comparing with a known structure in which the entire edge surfaces 24*c* and 24*d* of the torsion spring 24 are in contact with the groove portions 20*i* and 33*c*. Therefore, when the rotor 20 is rotated relative to the housing member 31, the contact resistance of the torsion spring 24 with the rotor member 20 according to the embodiment of the present invention is not affected on the rotation of the rotor member 20 as much as the conventional structure, thereby the performance of the various valve timing system 1 can be effectively improved.

According to the embodiment of the present invention, the groove portions 20*i* and 33*c* are respectively provided with the projections P1, P2, and P3. However, the number of the projections P1, P2, and P3 are not limited to a certain number. Further, the projections P1, P2, and P3 are not always required to be provided with both of the groove portions 20*i* and 33*c* and can be provided with either the groove portion 20*i* or 33*c*.

Next, the operation of the variable valve timing device 1 according to the embodiment of the present invention is described hereinbelow.

The rotation of the crank shaft 100 of the engine is transmitted to the gear 32 via the timing chain 90 so that the gear 32 is rotated in response to the rotation of the crank shaft 100. The gear 32 and the housing member 31 are fixed to each other by means of the fastening members 64 so as to be rotated as a single unit. For example, when the lock plate 61 is engaged with the lock bore 20*g*, the housing member 31 and the rotor 20 is rotated as a single unit. Therefore, the rotation of the crank shaft 100 is transmitted to the cam shaft 10. The cam shaft 10 is synchronously rotated having the predetermined relative phase to the crank shaft 100.

When the phase of the rotor member 20 relative to the housing member 31 is required to be moved in an advanced direction, i.e. in the clockwise direction, the operation oil is supplied to the lock bore 20*g* and the passage bores 20*f* and the operation oil in the retarded angle chambers R2 is exhausted via the passage bores 20*e*. In this case, the lock plate 61 is retracted from the lock bore 20*g* to the retracting bore 31*e* in response to the operation oil supplied to the lock bore 20*g*. The lock plate 61 does not restrain any more the rotor member 20 from being rotated relative to the housing member 31. The advanced angle changers R1 are then filled in with the operation oil supplied to the passage bores 20*f*, wherein the oil pressure in the advanced angle chambers R1 is applied to the vanes 21 at a greater pressure level than the oil pressure in the retarded angle chambers R2. Therefore, the vanes 21 are moved relative to the housing member 31 in the advanced direction so as to increase the volume of the advanced angle chambers R1 and to decrease the volume of the retarded angle chambers R2.

On the other hand, when the phase of the rotor member 20 relative to the housing member 31 is required to be moved in a retarded direction, i.e. in a counterclockwise direction, the operation oil is supplied to the retarded angle chambers R2 via the passage bores 20*e* and the operation oil in the advanced angle chambers R1 is exhausted. In this case, the oil pressure in the retarded angle chambers R2 is applied to the vanes 21 at a greater pressure level than the oil pressure in the advanced angle chambers R1. Therefore, the vanes 21 is moved relative to the housing member 31 so as to increase the volume of the retarded angle chambers R2 and to decrease the volume of the advanced angle chambers R1. That is, the phase control of the rotor member 20 relative to the housing member 30 can be performed by operating one of the chambers R1 and R2 as an operation oil supplied chamber and the other one thereof as an operation oil exhausted chamber.

As described above, when the relative rotation of the rotor member 20 and the housing member 31 is performed in response to the operation oil flaw, the edges surfaces 24*c* and 24*d* of the torsion spring 24 become in contact with the surfaces of the projections P1, P2, and P3, thereby the contact restriction between the torsion spring 24 and the plate member 33 (or the rotor member 20) may occur. According to the embodiment of the present invention, the contact area of the torsion spring 24 with the rotor 20 and the plate member 33 can be decreased so that the contact resistance can be naturally decreased. Therefore, the torsion spring 24 according to the embodiment of the present invention can be effectively arranged not to affect on the rotation of the rotor member 20.

The principles, preferred embodiment and mode of operation of the present invention have been described in the foregoing specification. However, the invention which is intended to be protected is not to be construed as limited to the particular embodiment disclosed. Further, the embodiment described herein is to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What we claim is:

1. A variable valve timing device comprising:

a rotation transmitting member rotated integrally with one of a rotation shaft of an engine and an intake and exhaust valves controlling member for controlling an opening and closing of intake and exhaust valves of the engine;

a rotor member disposed in the rotation transmitting member to be rotated relative to the rotation transmitting member and rotated integrally with the other of the rotation shaft of the engine and the intake and exhaust valves controlling member;

a fluid chamber defined between the rotor member and the rotation transmitting member;

a vane radially equipped to one of the rotor member and the rotation transmitting member so as to divide the fluid chamber into an advanced angle chamber and a retarded angle chamber;

a covering member fixed to the rotation transmitting member for covering the fluid chamber; and a biasing member disposed between the covering member and the rotor member for biasing the rotor member in a rotative direction thereof, wherein an axial edge surface of the biasing member discontinuously comes in contact with at least one of the rotor member and the covering member.

2. A variable valve timing device according to claim 1, wherein at least the one of the rotor member and the covering member includes a recessed portion for housing an axial edge portion of the biasing member, and the recessed portion possesses a discontinuous surface at a bottom thereof.

3. A variable valve timing device according to claim 2, wherein the biasing member is a torsion spring of which one end is engaged to the covering member and other end is engaged to the rotor member, the recessed portion for housing the axial edge portion of the torsion spring is a groove with a substantially helical shaped structure, the discontinuous surface is provided at a bottom of the groove with the substantially helical shaped structure.

4. A variable valve timing device according to claim 3, wherein the discontinuous surface possesses a predetermined angle relative to a surface vertical to an axis of at least the one of the rotor member and the covering member in accordance with an edge surface of the torsion spring.

5. A variable valve timing device according to claim 1, wherein the rotation transmitting member includes a housing member and a gear, the gear is provided with a sprocket portion on an outer peripheral surface so that the rotation transmitting member is integrally rotated with the one of the rotation shaft of the engine and the intake and exhaust valve controlling member via a chain, the rotation shaft of the engine includes a crank shaft, and the intake and exhaust valve controlling member includes a cam shaft.

6. A variable valve timing device according to claim 5, wherein the housing member and the gear is a separated or single unit.

7. A variable valve timing device according to claim 1, further comprising:

a bore defined in the housing member;

a retracting bore defined in the housing member in a radial direction;

a lock spring of which one end is engaged to an inner wall of the bore;

a lock plate of which one end is in contact with the other end of the lock spring and assembled to be freely slidable between the bore and the retracting bore in the radial direction; and the rotor including a lock groove, wherein the retracting bore and the lock groove oppose to each other in response to the rotor member positioned with a predetermined phase relative to the housing member so that the lock plate is biased by the lock spring to be engaged to the lock groove and the relative rotation of the rotor member and the rotation transmitting member is not allowed, and the lock plate is released from the engaged condition with the lock groove and is retracted to the retracting bore in response to an operation oil supplied to the lock groove so that the relative rotation of the rotor member and the rotation transmitting member is allowed.

8. A variable valve timing device comprising;

a rotation transmitting member rotated integrally with a rotation shaft of an engine;

a rotor member disposed in the rotation transmitting member to be rotated relative to the rotation transmitting member an intake and exhaust valves controlling member slidably inserted into the rotation transmitting member so as to be rotated relative to the rotation transmitting member and fixed to the rotor member so as to be rotated integrally therewith, the intake and exhaust valves controlling member for controlling an opening and closing of intake and exhaust valves of the engine;

a fluid chamber defined between the rotor member and the rotation transmitting member;

a vane radially disposed in the rotor member so as to divide the fluid chamber into an advanced angle chamber and a retarded angle chamber;

a covering member fixed to the rotation transmitting member from an axially opposite side to the intake and exhaust valves controlling member; and a biasing member disposed between the covering member and the rotor member for biasing the rotor member in a rotative direction thereof, wherein an axial edge surface of the biasing member discontinuously comes in contact with at least one of the rotor member and the covering member.

9. A variable valve timing device according to claim 8, wherein at least the one of the rotor member and the covering member includes a recessed portion for housing an axial edge portion of the biasing member, and the recessed portion possesses a discontinuous surface at a bottom thereof.

10. A variable valve timing device according to claim 9, wherein the biasing member is a torsion spring of which one end is engaged to the covering member and other end is engaged to the rotor member, the recessed portion for housing the axial edge portion of the torsion spring is a groove having a substantially helical shaped structure, the discontinuous surface is provided at a bottom of the groove having the substantially helical shaped structure.

11. A variable valve timing device according to claim 10, wherein the discontinuous surface possesses a predetermined angle relative to a surface vertical to an axis of at least the one of the rotor member and the covering member in accordance with an edge surface of the torsion spring.

12. A variable valve timing device according to claim 8, wherein the rotation transmitting member includes a housing member and a gear, the gear is provided with a sprocket portion on an outer peripheral surface so that the rotation transmitting member is integrally rotated with the rotation shaft of the engine via a chain, the rotation shaft of the engine includes a crank shaft, and the intake and exhaust valve controlling member includes a cam shaft.

13. A variable valve timing device according to claim 12, wherein the housing member and the gear is a separated or single unit.

14. A variable valve timing device according to claim 8, further comprising:

a bore defined in the housing member;

a retracting bore defined in the housing member in a radial direction;

a lock spring of which one end is engaged to an inner wall of the bore;

a lock plate of which one end is in contact with the other end of the lock spring and assembled to be freely slidable between the bore and the retracting bore in the radial direction; and the rotor including a lock groove, wherein the retracting bore and the lock groove oppose to each other in response to the rotor member positioned with a predetermined phase relative to the housing member so that the lock plate is biased by the lock spring to be engaged to the lock groove and the relative rotation of the rotor member and the rotation transmitting member is not allowed, and the lock plate is released from the engaged condition with the lock groove and is retracted to the retracting bore in response to an operation oil supplied to the lock groove so that the relative rotation of the rotor member and the rotation transmitting member is allowed.

* * * * *